United States Patent [19]

Wenzel

[11] Patent Number: 4,508,187

[45] Date of Patent: Apr. 2, 1985

[54] POWERED ROLLER SKATES

[76] Inventor: William B. Wenzel, 343 Maitland Dr., Alameda, Calif. 94501

[21] Appl. No.: 397,504

[22] Filed: Jul. 12, 1982

[51] Int. Cl.[3] ..... A63C 17/12

[52] U.S. Cl. ..... 180/181

[58] Field of Search ..... 180/180, 181, 11, 63, 180/74; 280/11.115, 11.19; 15/405, 327 C

[56] References Cited

U.S. PATENT DOCUMENTS

| | | | |
|---|---|---|---|
| 823,385 | 6/1906 | Beauford | 180/181 |
| 907,475 | 12/1908 | Domman | 280/11.115 |
| 2,509,603 | 5/1950 | Marin | 180/180 |
| 2,625,229 | 1/1953 | Voorhees | 180/181 |
| 2,857,008 | 10/1958 | Pirrello | 180/181 |
| 3,224,785 | 12/1965 | Stevenson | 180/180 |
| 3,876,032 | 4/1975 | Ferino | 180/9.2 R |

FOREIGN PATENT DOCUMENTS

| | | | |
|---|---|---|---|
| 561281 | 6/1944 | United Kingdom | 180/181 |

*Primary Examiner*—Joseph F. Peters, Jr.
*Assistant Examiner*—Joseph G. McCarthy
*Attorney, Agent, or Firm*—Owen, Wickersham & Erickson

[57] ABSTRACT

A powered roller skate apparatus includes a motor supported on the back of a user, with a flexible drive extending from the motor to a front wheel truck for a standard roller skate. The wheel truck is interchangeable with that of any standard roller skate, and only one bolt need be removed and replaced to effect the change.

Instead of an internal shaft to drive the one driven wheel, the wheel drive system includes a hub adjacent to the outside of the wheel, and a series of prongs extend from the hub directly into the side of the urethane wheel. Gear reduction from the motor is achieved through two angle drive gear boxes, one at each end of the flexible drive, which may include different-sized gears for the reduction, at the same time this enabling the flexible drive to be oriented generally upright between the skate and the motor. The motor is supported on a back pack type frame, with a pair of handle bars extending forwardly at the hips of the user, including a throttle control and a rope start handle mounted on these handle bars.

3 Claims, 8 Drawing Figures

FIG. 4
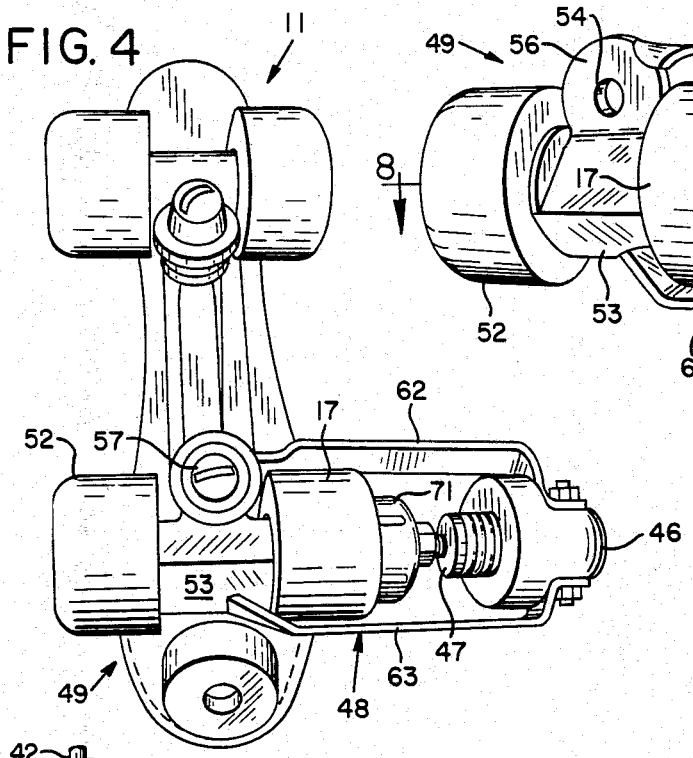
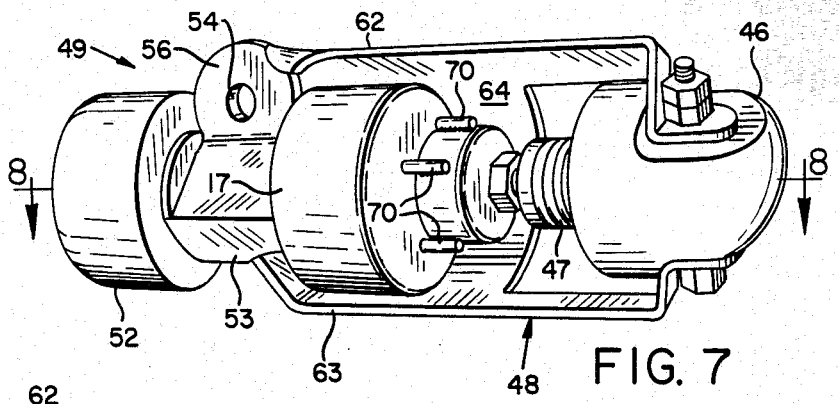
FIG. 7
FIG. 5
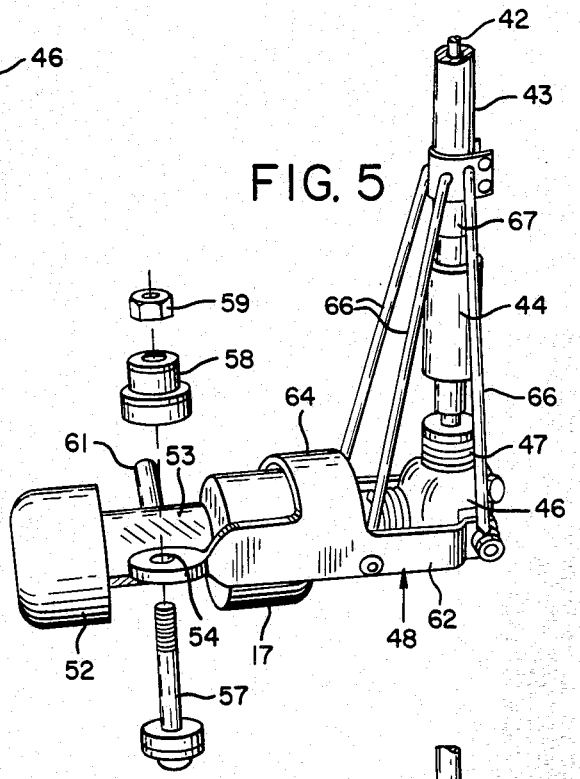
FIG. 6
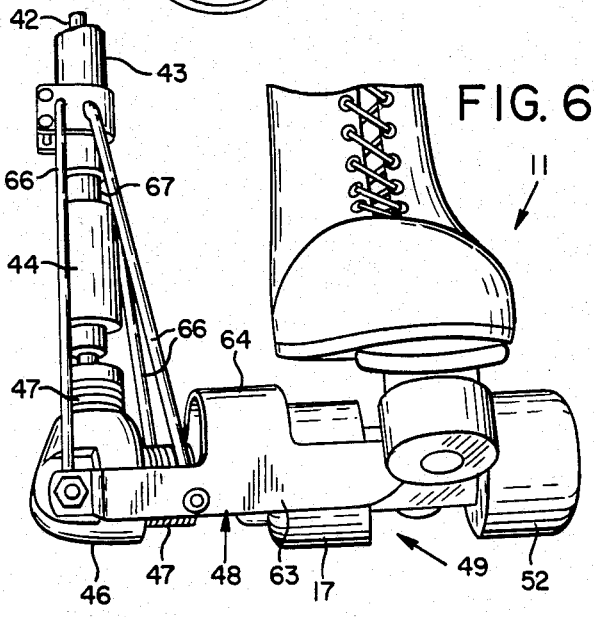
FIG. 8
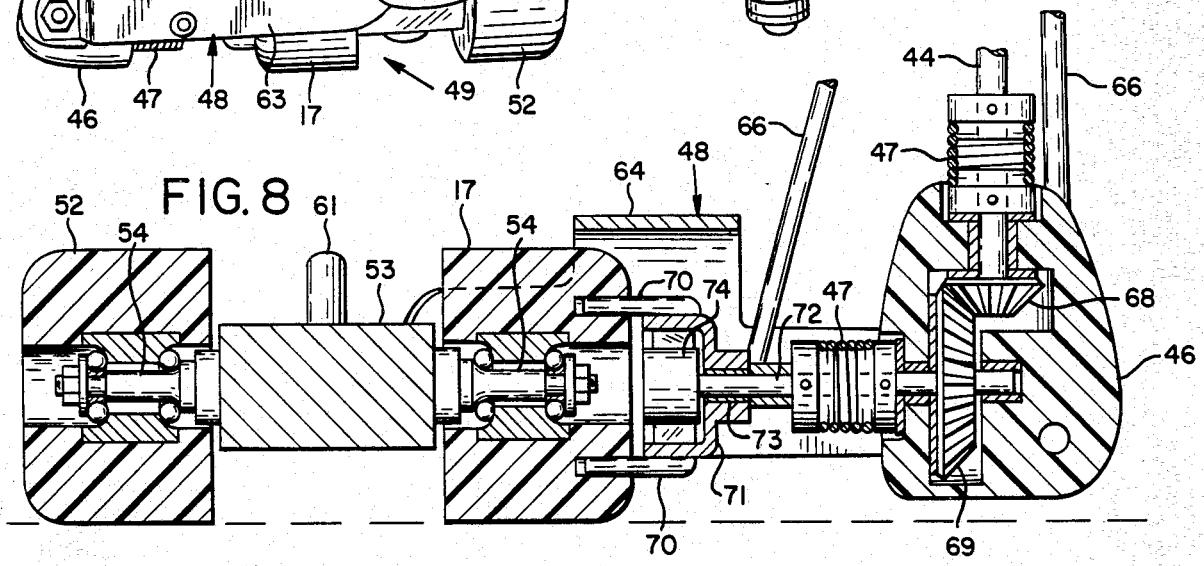

POWERED ROLLER SKATES

BACKGROUND OF THE INVENTION

The invention relates to propelled vehicular apparatus, and more particularly to powered roller skates.

Various forms of powered roller skates or similar devices have been suggested previously. See, for example, U.S. Pat. Nos. 2,857,008 and 3,876,032. U.S. Pat. No. 2,857,008 shows a roller skate powered by a motor carried on the back of the user, with a flexible drive leading from the motor to the rear wheel truck of one skate. The driven wheel of the patent was driven via a ratchet arrangement so that the wheels could freewheel over the speed of the motor. A special bearing-mounted axle was provided for the driven wheel, with a bevel drive gearing internal to the wheel truck, and a drive shaft extending upward and outward from the center rear of the skate.

None of the prior art powered roller skate apparatus included features enabling universality of application of a powered wheel truck to standard roller skates, nor did the prior art contemplate an efficient drive system in combination with the safer front wheel drive. Further, the prior art lacks any teaching of an efficient back-pack type carrying system that includes convenient throttle controle operation and starting and stopping of the motor.

SUMMARY OF THE INVENTION

The powered roller skate device of the present invention improves on prior devices in several important ways. One very important feature of the invention is its universality. A motor and flexible drive are connected to a front wheel truck for a standard urethane-wheel roller skate. A single bolt on these standard skates retains the front wheel truck in place, designed with rubber cushioning to permit tipping or rocking of the skate on the wheel truck axis. The single bolt is extracted to remove the conventional wheel truck, and the powered wheel truck of the invention is put in its place and retained by the same single bolt, still providing for cushioned tipping as with the standard wheel truck.

The powering of a front wheel rather than a rear wheel is important for stability and safety. Unlike rear wheel drive, if the user abruptly applies power to the front wheel and the skate front tips up, the front wheel lifts off the pavement so that balance is quickly regained.

Another important feature is the wheel drive system of the invention. One wheel of the front wheel truck is driven by the flexible drive, preferably through a right angle drive-direction changing gear box, so that the flexible drive can extend generally upwardly, rather than outwardly from the skate. Rigid struts extend outwardly, around the driven wheel, from a rigid bar between the two front wheels. These struts support the right-angle gear box and absorb reactive torque from the gear box when power is applied. Connected to the drive output of the gear box is a hub adjacent to the driven wheel, and a plurality of prongs from the hub extend directly into the side of the urethane wheel to drive it. Thus, no special wheel shaft and bearing arrangement is necessary, and the wheel can be bearing-mounted in the same way as a standard roller skate wheel.

Preferably, a ratchet or other one-way drive device is included in the drive hub or elsewhere between the flexible drive and the driven wheel to permit freewheeling in the forward direction when the user desires to coast and power is throttled. Also, gear reduction from the motor is desirable, and this may be accomplished in the right angle gear box, of which there may be two—one at either end of the flexible drive.

The motor may be supported on the user's back with a frame and shoulder straps. One preferred feature of the invention is that the frame include handle bars extending forwardly along the hips, with a throttle control lever on one handle bar for easy reach and operation. A rope-start handle preferably is also positioned along a handle bar within the user's reach, leading back to an internal combustion engine via pulleys. A centrifugal clutch may be used to control power application to the flexible drive.

Accordingly, a powered roller skate device according to the invention may comprise a motor and means for supporting the motor on a user's body, a front wheel truck for fitting a standard roller skate, including a central rigid bar, a pair of wheels rotatably supported by the rigid bar at its ends, and means attached to the rigid bar for removably mounting the front wheel truck on a standard roller skate. The mounting means are interchangeable with a standard front wheel truck and have removable fastening means typical of a standard front wheel truck. Flexible drive means extend between the motor and the front wheel truck. Wheel drive means are connected to and powered by the flexible drive means for driving one wheel of the front truck, and there is provided a motor control means for regulating the speed of the motor.

It is therefore among the objects of the invention to improve on previous powered roller skate devices by safely driving a front wheel of the skate via a modular front wheel truck that fits nearly any conventional soft-wheel roller skate. Some other objects are to improve on previous wheel drive and drive train mechanisms and to provide convenience and ease of use of the powered roller skate apparatus. Other objects, advantages, features and characteristics of the invention will be apparent from the following description of a preferred embodiment, considered along with the accompanying drawings.

DESCRIPTION OF THE DRAWINGS

FIG. 4 is a bottom view of the roller skate.

FIG. 5 is a perspective view, partially exploded, showing the wheel truck drive assembly.

FIG. 6 is a front elevation view of a skate with the drive apparatus attached.

FIG. 7 is a view showing details of the wheel truck drive assembly.

FIG. 8 is a sectional elevation view, taken along the line 8—8 of FIG. 7, showing the drive train in the wheel truck drive assembly.

DESCRIPTION OF A PREFERRED EMBODIMENT

Figure 1:
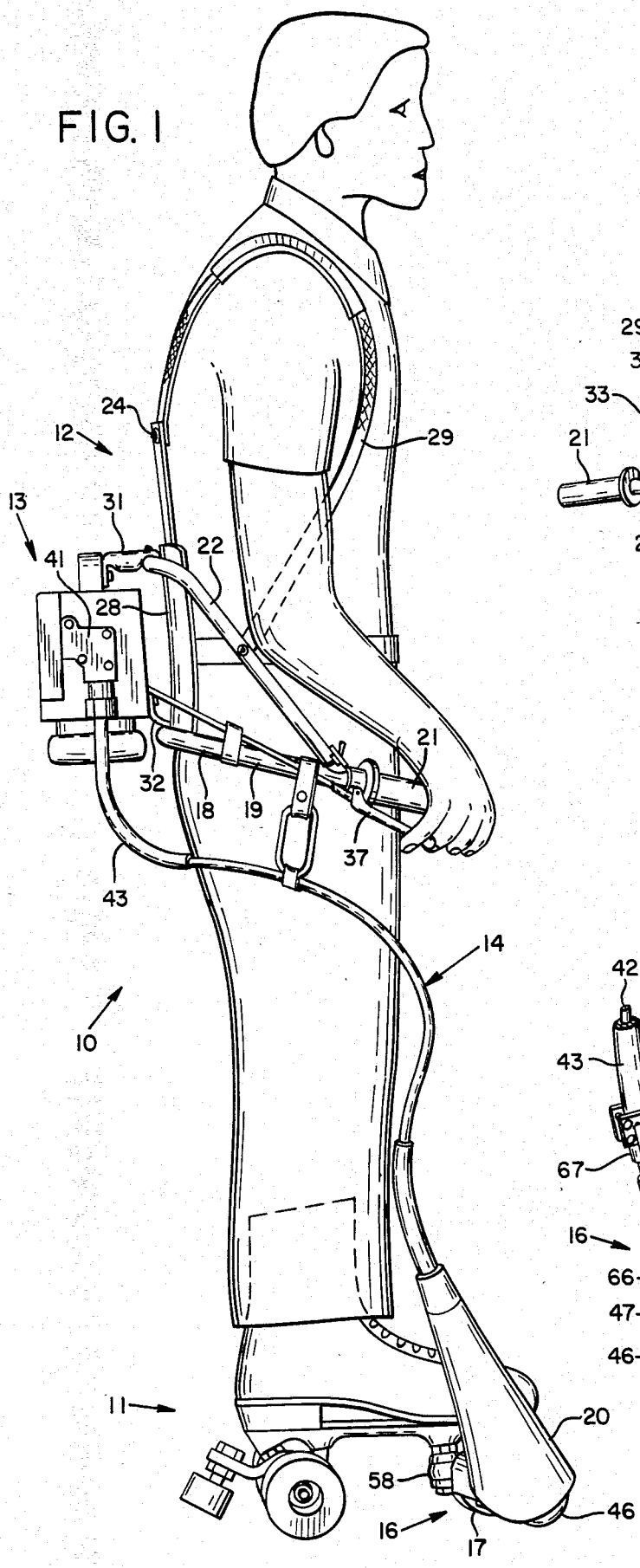
FIG. 1 is a side elevation view of a powered roller skate apparatus according to the invention, as worn on the back of a user and connected to a roller skate.

FIG. 1 shows a powered roller skate apparatus 10 according to the invention, as worn on the back of a user and connected to one roller skate 11. The apparatus 10 includes a back pack type frame 12 supporting a motor 13, which is connected by a flexible drive 14 to a wheel drive unit 16 which is in turn connected to one front wheel 17 of the roller skate 11. The wheel drive unit 16 and associated structure may be covered by a removable shroud or sheath 20.

Figure 2:
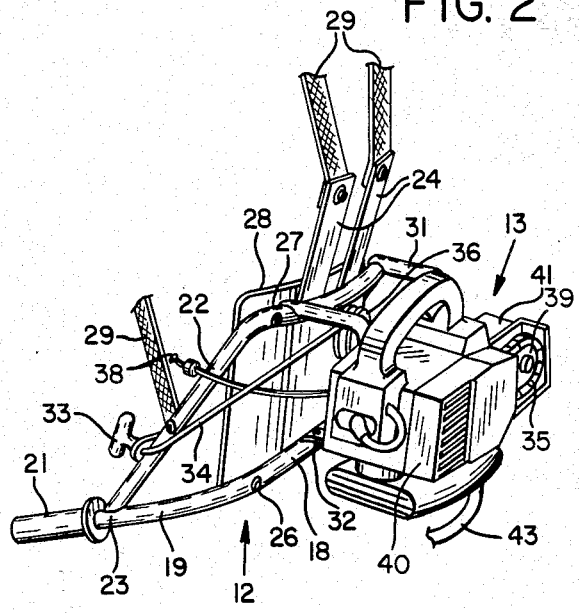
FIG. 2 is a perspective view showing the motor, attached to a back pack type frame.

FIGS. 1 and 2 show the preferred construction of the back-carried frame 12. It may include a lowered frame member 18 terminating in a pair of handle bars 19 which extend forwardly adjacent to or somewhat below the hips of the user. Hand grips 21 may be secured to the ends of the handle bars 19. An upper frame member 22, generally U-shaped and somewhat similar to the frame member 18, is affixed to the lower frame member 18 at points 23 just behind the hand grips 21. Together with a pair of vertical relatively rigid braces 24, the members 18 and 22 form a frame for positioning on the back of the user. The frame members 18 and 22 are connected to the vertical braces 24 where they cross them, at locations 26 and 27. A soft padding 28 is connected to and positioned on the front side of the vertical brace 24 for engaging the back of the user, and straps 29 extend as indicated, for securement over the user's shoulders in the typical manner of a back pack.

The motor 13 is connected to the rear of the frame assembly 12, and this may be by appropriate braces and struts as shown at 31 and 32. The motor may be a small gasoline-powered internal combustion engine such as the chain saw engine indicated, and preferably there is a rope start handle 33 on one of the handle bars 19 or the frame member 22, within reach of the operator for starting the motor. This leads to the motor via a cord 34 passing over one or more pulleys 36. A throttle control 37 is connected to one of the handle bars 19 adjacent to a hand grip 21, and a choke control 38 preferably is also provided within reach of the operator, as indicated in FIG. 2.

The motor 13 may be in driving connection with the roller skate wheel 17 via a chain 35 driving a sprocket 39, which in turn drives a right angle gear box 41 the output of which is connected to a flexible drive shaft 42 which passes through the outer sheath 43 of the flexible drive unit 14. A reduction gearing unit 40 may be included to reduce motor speed upstream of the chain, and this unit 40 may include a clutch, preferably a centrifugal clutch, as is typically included in a chain saw engine, so that the clutch is engaged when the engine reaches a specified speed above idle.

The output end 44 of the flexible drive shaft connects to a second right angle gear box 46, 47 (FIG. 3) whose output shaft is connected to the wheel 17.

Figure 3:
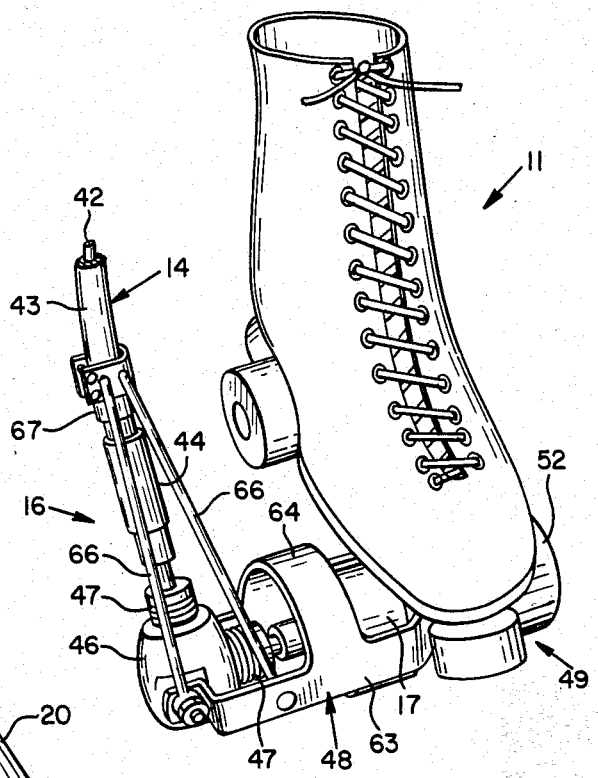
FIG. 3 is a perspective view showing a roller skate with the wheel drive apparatus of the invention attached.

A structural support 48 extends from the front wheel truck 49 including the wheel 17 out to support the flexible drive 14 and the drive direction changing gear box 46, 47, as indicated in FIG. 3. This apparatus is better understood with reference to FIGS. 4 through 8, along with the perspective view of FIG. 3.

As shown more clearly in FIGS. 4 through 8, the drive wheel 17 forms an outer wheel of the front wheel truck 49. Thus, if the driving truck 49 is on the right roller skate 11, as indicated in these drawings, the drive wheel 17 is the right front wheel. The driving front wheel truck 49 has another wheel 52 and a rigid bar 53 between the wheels, each of which is bearing-mounted on a shaft 54 extending into the wheel from the rigid bar (see FIG. 8). There is no drive shaft internally connected to the drive wheel 17, and the wheel truck 53 is very much like an ordinary, standard wheel truck for urethane-wheeled roller skates as depicted. The removable wheel truck 49, as shown in FIGS. 5 and 7, has a bolt eye opening 54 in structure 56 extending from the rigid bar 53, for receiving a bolt 57 for retaining the wheel truck on the skate. As indicated in FIG. 5, the bolt 57 passes through the eye 54, then through a rubber bushing assembly 58 and a threaded nut 59, and thence into a threaded opening (not shown) in the bottom of the skate, as is typically provided for this type of standard mounting. Opposite the eye 54 is a pin 61, also secured to the rigid bar 53, for extending into an opening in the bottom of the skate (not shown), also a standard feature of this type of mount. This enables the standard wheel truck to be readily removed with the removal of one bolt, while also being stabilized by the pin-and-hole connection and permitted an appreciable degree of tilting or rocking movement with respect to the bottom of the skate. These are standard features of modern urethane-wheel roller skates.

Because of this provision for connecting to a standard wheel truck mounting, the powered wheel truck 51 and thus the entire powered roller skate apparatus 10 can be easily and quickly connected to any standard urethane-wheel roller skate.

As illustrated in FIGS. 3 through 8, the structural support 48 for the wheel drive apparatus 46, 47 may comprise a pair of horizontal braces 62 and 63 fixed to the central rigid bar 53 of the truck and extending outwardly. The brace 62 is connected to the bolt eye structure 56, which in turn is fixed to the bar 53. A cross-brace 64, which may lie above the wheel 17, preferably connects the two braces 62 and 63 as shown. From the braces 62 and 63 a pair of struts 66 extend upwardly to support the terminal end 67 of the flexible drive sheath 43. Also, the drive-direction changing gear box 46 is connected to the outer ends of the horizontal braces 62 and 63 as indicated. Thus, the gear box 46, 47 (the exterior of which may be of soft but durable material such as urethane, like the wheels) is relatively rigidly supported with respect to the wheel truck 51 and the end 67 of the cable sheath 43 is also supported therefrom in a relatively rigid arrangement.

The support of the gear box 46 from the central rigid bar 53 is an important feature of the invention, especially with the structure so arranged that the drive wheel truck 51 can still fit universally on standard roller skates. However, it should be understood that the particular structure shown in the drawings for supporting the gear box and the flexible drive sheath end 67 is merely for purposes of illustration. Other suitable structural arrangements may be used.

As shown in FIG. 8, the bevel gear box 46 may have a smaller input gear 68 and a larger output gear 69, the two enmeshed bevel gears providing a gear reduction at that point. The upper gear box 41 (FIG. 1), between the motor and the flexible drive, may also include reduction bevel gearing or other types of reduction gearing, so that the drive speed at the wheel 17 is significantly reduced from the speed of the motor's output shaft. The amount of reduction needed will vary with the type of engine used.

Another important feature of the powered roller skate apparatus 10 is the manner in which the drive wheel 17 is driven. This is best seen with reference to FIGS. 7 and 8. The driven wheel 17 is a standard urethane roller skate wheel, similar to its counterpart 52 at the other end of the rigid bar 53, and bearing mounted in the same manner. Two, three or more prongs 70 extend directly into the side of the wheel 17 as best seen in the sectional view of FIG. 8, and these are in driving engagement with the shaft 72 at the output of the gear box 46. The driving connection is through a hub 71 from which the prongs 70 extend and this may be secured directly to the shaft 72, if desired. However, it is preferred that a one-way drive be provided, as discussed above, so that the skate can freewheel at times when it is overspeeding the engine, and the user will not be slowed down by the engine. For this purpose, the shaft 72 from the output of the unit 46, 47 extends through a bearing 73 in the hub 71 and connects to a one-way drive assembly 74, within the hub. This may be a pawl-and-ratchet assembly of typical configuration, as indicated in FIG. 8.

The powered roller skate apparatus of the invention has the advantages over prior such devices of safety, economy, universality of application and quick and easy interchange from one roller skate to another. Various other embodiments and modifications of the preferred embodiment described above may be made by those skilled in the art without departing from the spirit and scope of the invention as defined in the following claims.

I claim:

1. A powered roller skate device, comprising:

a motor and means for supporting the motor on a user's body;

a front wheel truck for a two-axel roller skate, with a pair of wheels, and means for removably mounting the front wheel truck on a standard roller skate, interchangeably with a standard two-axel front wheel truck;

flexible drive means extending between the motor and the front wheel truck, having an upper end at the motor and a lower end at the front wheel truck;

clutch means for selectively engaging the motor with the flexible drive means;

gear reduction means at at least one end of the flexible drive means;

drive direction-changing means between the lower end of the flexible drive means and the front wheel truck, for converting rotation about a generally downwardly oriented axis in the flexible drive means into rotation about a horizontal axis at the wheel truck;

wheel drive means connected to the direction-changing means, for directly engaging one wheel of the front truck from its outer side, to drive the one wheel directly at the rate of rotation of the direction-changing means when power is applied from the motor;

the front wheel truck including a rigid bar between the wheels and supporting the wheels for rotation with respect to the bar, means affixed to the rigid bar for supporting the removable mounting means, and strut means secured to the rigid bar and extending laterally outwardly, around the one driven wheel, to a supporting connection with the direction-changing means, positioning the horizontal output axis of the direction-changing means generally coextensively with the axis of the one driven wheel;

ratchet means associated with the wheel drive means, for driving the one wheel when power is applied but for permitting free-wheeling coasting of the one wheel without resistance from the motor when power is cut; and motor control means for regulating the speed of the motor.

2. The powered roller skate device of claim 1, wherein the wheel drive means includes a hub rotatable generally coextensively with the horizontal output axis of the direction-changing means and positioned closely adjacent to the one driven wheel, and at least two spaced prongs fixed to the hub and penetrating into the driven wheel.

3. The powered roller skate device of claim 2, further including an inner shaft associated with the hub and rotatably connected to the direction-changing means, with the ratchet means operative between the inner shaft and the hub.

* * * * *